United States Patent [19]

Nevins, Jr. et al.

[11] 3,972,005

[45] July 27, 1976

[54] ULTRAWIDE BAND TRAVELING WAVE TUBE AMPLIFIER EMPLOYING AXIALLY CONDUCTIVE CIRCUIT LOADING MEMBERS

[75] Inventors: John E. Nevins, Jr., Encino, Calif.; Lester M. Winslow, Buffalo Grove, Ill.

[73] Assignee: Varian Associates, Palo Alto, Calif.

[22] Filed: Dec. 16, 1969

[21] Appl. No.: 885,578

[52] U.S. Cl. ..... 330/43; 315/3.5; 315/39.3

[51] Int. Cl.[2] ..... H01J 25/34

[58] Field of Search ..... 315/3.5, 39.3; 330/43

[56] References Cited

UNITED STATES PATENTS

| | | | |
|---|---|---|---|
| 2,681,427 | 6/1954 | Brown | 315/39.3 |
| 3,387,168 | 6/1968 | Beaver | 315/3.5 |
| 3,397,339 | 8/1968 | Beaver et al. | 315/3.5 |
| 3,506,872 | 4/1970 | Bittorf et al. | 315/3.5 |

*Primary Examiner*—Howard A. Birmiel
*Attorney, Agent, or Firm*—Stanley Z. Cole; Richard B. Nelson; Robert K. Stoddard

[57] ABSTRACT

An ultra wide band traveling wave tube amplifier is disclosed. The amplifier employs a helix derived slow wave circuit arranged for electromagnetic interaction with a beam of electrons passable axially through the helix circuit. Signals to be amplified within the passband of the circuit interact with the electron stream to produce an amplified output signal which is extracted from the helix and coupled to a suitable utilization device. The bandwidth of the traveling wave tube amplifier is substantially increased by the provision of a conductive circuit loading structure disposed surrounding the helix circuit and extending for at least half of its length and preferably for substantially its entire length. The conductive circuit loading structure includes a plurality of conductors disposed surrounding the helix and arranged to conduct current associated with the radio frequency fields surrounding the helix substantially only in the radial or axial direction of the helix and not in the circumferential direction of the helix. Such a conductive loading structure causes the slow wave circuit to have a circuit wave velocity which increases with frequency over the passband of the circuit. This permits the slow beam space charge wave of the electron stream to remain in synchronism with the circuit wave over a wider band of frequencies and to provide a substantially constant Pierce synchronism parameter *b* over an ultra wide band of frequencies as of two octaves. In a preferred embodiment, the conductive loading structure is formed by a plurality of open sided channel members extending longitudinally of the helix and positioned with the open sides of the channels facing the helix to provide a plurality of conductive vane-shaped members.

4 Claims, 10 Drawing Figures

INVENTORS
JOHN E. NEVINS JR.
LESTER M. WINSLOW
BY Gerald L Moore
ATTORNEY

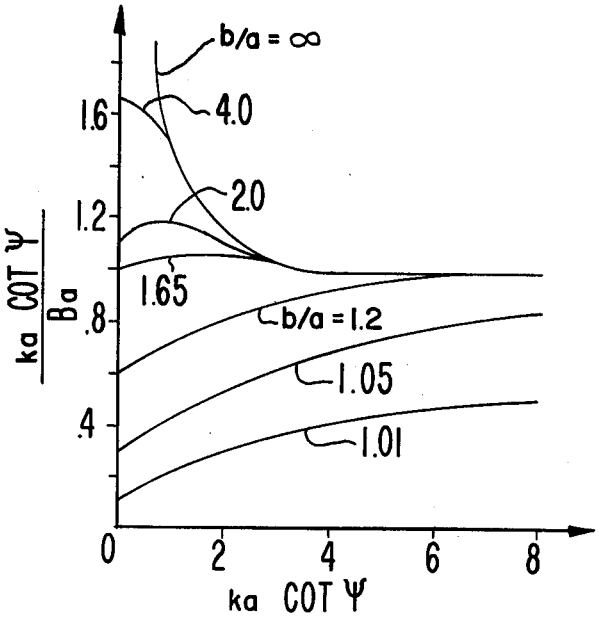
FIG. 6
FIG. 7
PRIOR ART
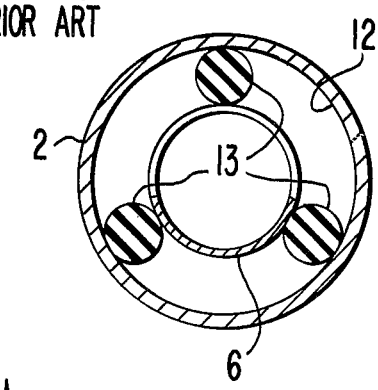
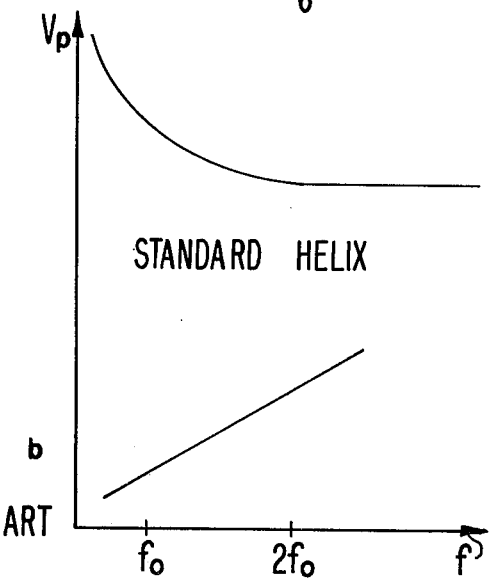
FIG. 8
PRIOR ART
FIG. 9
PRIOR ART
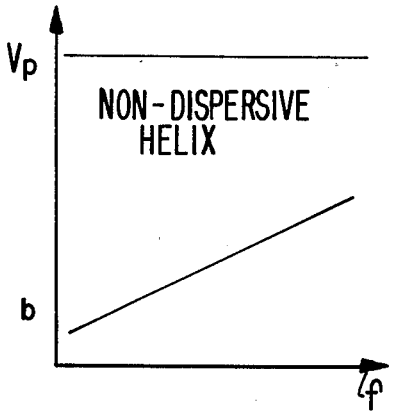
FIG. 10
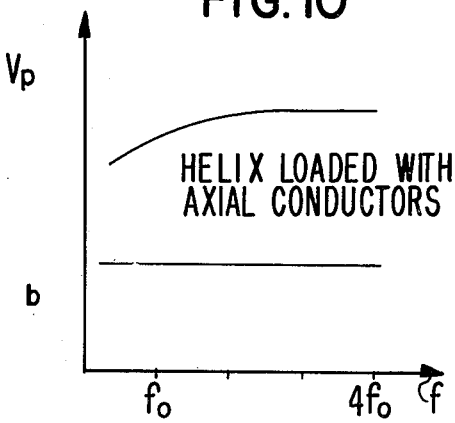
INVENTORS
JOHN E. NEVINS JR.
LESTER M. WINSLOW
BY
Gerald L Moore
ATTORNEY

ULTRAWIDE BAND TRAVELING WAVE TUBE AMPLIFIER EMPLOYING AXIALLY CONDUCTIVE CIRCUIT LOADING MEMBERS

DESCRIPTION OF THE PRIOR ART

Heretofore, attempts have been made to improve the bandwidth of helix-type traveling wave tubes by bringing the outer conductive sheath closer than normal to the slow wave circuit for loading the circuit and causing the phase velocity of the circuit to be nearly constant over a wide band of frequencies. Alternatively, dielectric material has been inserted between the outside of the helix and the surrounding metallic sheath in which it is disposed for similarly loading the slow wave circuit to provide a constant phase velocity. The problem with loading of the helix circuit to provide a nearly constant phase velocity over a wide band of frequencies is that the synchronism parameter *b* for such a nondispersive signal has a characteristic which increases with frequency across the band of the tube. Therefore, such loaded tubes have been limited to bandwidths on the order of one octave.

It is known from the video delay line art that the phase velocity of a helix delay line can be made relatively constant over a wide band of frequencies or can be made to have an increasing phase velocity with frequency by loading the helix circuit with a plurality of axially-directed conductive wires disposed about the outside of the helix. Such loading wires conduct current substantially only in the axial direction and are employed, in the video delay line art, to provide a constant phase velocity over a wide band of frequencies. Such a loading structure for video delay lines is described by D. A. Watkins in a book titled "Topics in Electromagnetic Theory" at pages 62–65, published by Wiley of New York in 1958.

It is known that band edge oscillations associated with helix-type circuits in traveling wave tube amplifiers may be suppressed by providing a plurality of attenuating vanes disposed about the outer surface of the slow wave helix circuit. Such a structure is described in U.S. patent application Ser. No. 452,279 filed Apr. 30, 1965 and assigned to the same assignee as the present invention.

SUMMARY OF THE PRESENT INVENTION

The principal object of the present invention is the provision of an improved traveling wave tube amplifier employing a helix derived slow wave circuit.

One feature of the present invention is the provision, in a helix derived traveling wave tube amplifier, of a conductive circuit loading structure disposed around the outside of the slow wave circuit and extending along the circuit for more than half of its length, such loading structure being arranged to interrupt currents tending to flow in a circumferential direction around the outside of the helix while permitting currents to be conducted lengthwise of the helix and in a radial direction. Such a loading structure provides a phase velocity for signal wave energy which increases with frequency over the passband of the slow wave circuit to provide a nearly constant synchronism parameter *b* over the passband of the slow wave circuit.

Another feature of the present invention is the same as the preceding feature wherein the helix derived slow wave circuit is surrounded by a conductive sheath and wherein the circuit loading structure projects from the surrounding conductive sheath inwardly toward the slow wave circuit.

Another feature of the present invention is the same as any one of more of the preceding features wherein the conductive loading members are open-sided conductive channels with the open side of the channel members facing the slow wave circuit, whereby the loading structure is conveniently formed in practice.

Another feature of the present invention is the same as any one or more of the preceding features wherein the radial spacing, *b*, from the axis of the slow wave circuit to the inside surface of the conductive loading members is within the range of 1.6 to 1.02 times the radial spacing, a, from the axis of the slow wave circuit to the outside surface of said slow wave circuit, whereby the loading members cause the phase velocity of wave energy on the circuit to increase with frequency over the passband thereof.

Other features and advantages of the present invention will become apparent upon a perusal of the following specification taken in connection with the accompanying drawings wherein:

BRIEF DESCRIPTION OF THE DRAWINGS

FIG. 6 is a plot of phase velocity of the video delay line of FIG. 5 (*a–b*) for various ratios of the radius of the helix to the radius of the inside surface of the loading sheath.

FIG. 7 is a transverse sectional view of a standard prior art helix slow wave circuit.

FIG. 8 is a plot of phase velocity, $V_p$, and Pierce's synchronism parameter, *b*, versus frequency, *f*, for the standard helix of FIG. 7, FIG. 9 is a plot similar to that of FIG. 8 for a non-dispersive helix, and FIG. 10 is a plot similar to that of FIGS. 8 and 9 for the helix loaded with axial conductors according to the teachings of the present invention.

DESCRIPTION OF THE PREFERRED EMBODIMENTS

Figure 1:
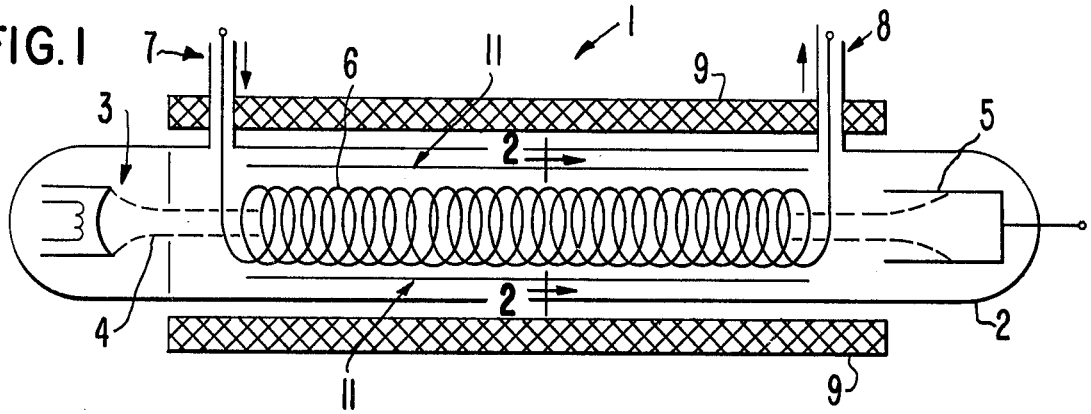
FIG. 1 is a schematic longitudinal sectional view of a helix derived traveling wave tube amplifier incorporating features of the present invention.

Referring now to FIG. 1, there is shown a traveling wave tube 1 incorporating features of the present invention. The tube 1 includes an evacuated envelope 2, as of copper, containing an electron gun assembly 3 at one end thereof for forming and projecting a beam of electrons over an elongated beam path 4 to an electron collector electrode 5 at the opposite end of the envelope 2. A helix slow wave circuit 6 is arranged along the beam path 4 intermediate the electron gun 3 and the beam collector 5 for electromagnetic interaction with the beam. Input microwave signals to be amplified are applied to the upstream end of the slow wave circuit 6 via an input coaxial line 7 and amplified output signals are extracted from the downstream end of the slow wave circuit 6 via an output coaxial line 8. A solenoid 9 is coaxially disposed surrounding the tube's envelope 2 for producing an axially directed magnetic beam focusing field within the beam 4 for focusing the beam through the helical slow wave structure 6.

A conductive slow wave circuit loading structure 11 is disposed outside of and adjacent the slow wave circuit 6 and extending along the circuit 6 over more than half of its length for interrupting circumferentially directed currents associated with fields around the outside of the slow wave circuit while conducting currents along the length of the slow wave circuit 6. The loading structure 11 provides a phase velocity for signal wave energy on the circuit 6 which increases with frequency over the passband of the slow wave circuit to provide a nearly constant synchronism parameter, *b*, over the passband of the slow wave circuit. The conductive circuit loading structure 11 is more fully described below with regard to FIGS. 2–4 and serves to cause the traveling wave tube to have an ultra wide bandwidth of approximately two octaves, i.e., from $f_0$ at the lower edge of the passband of the circuit to $4 f_0$ at the upper frequency edge of the passband.

Figure 2:
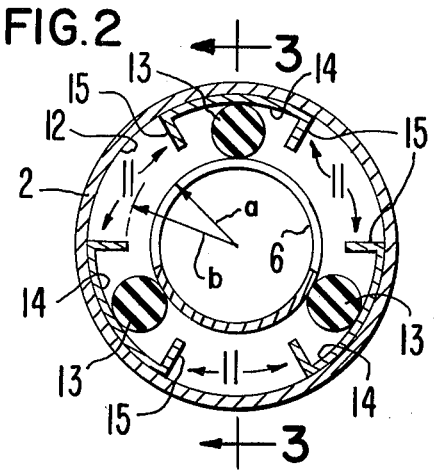
FIG. 2 is an enlarged cross sectional view of a portion of the structure of FIG. 1 taken along line 2—2 in the direction of the arrows.
Figure 3:
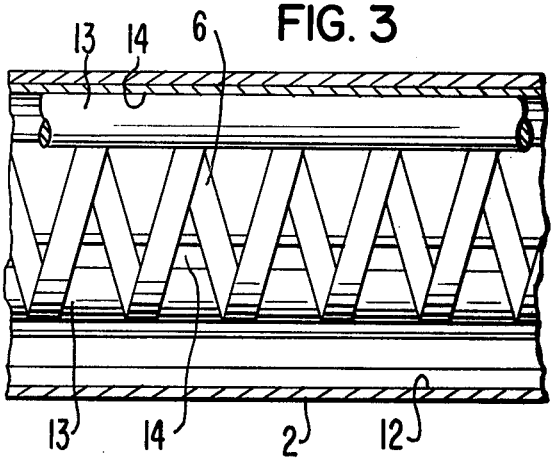
FIG. 3 is a sectional view of the structure of FIG. 2 taken along line 3—3 in the direction of the arrows.
Figure 4:
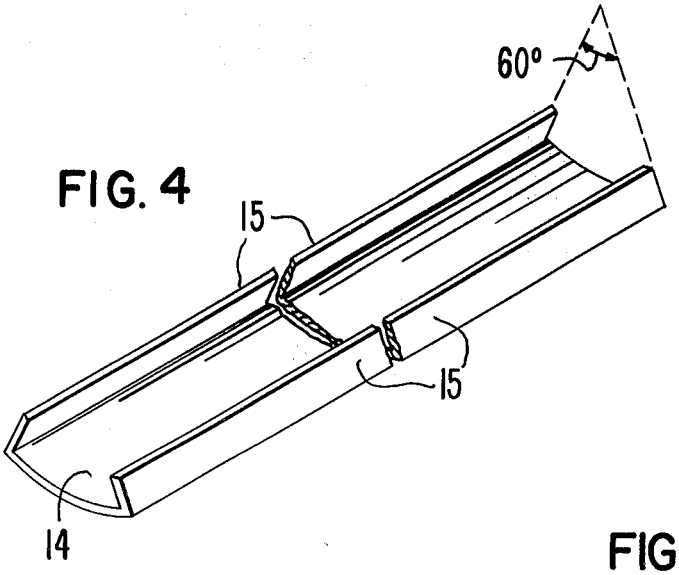
FIG. 4 is an enlarged perspective view of a channel loading member of the present invention, FIG. 5 (*a–b*) is a schematic line diagram of a helix video delay line loaded by a conductive sheath arranged to conduct only in the axial direction along the length of the helix.

Referring now to FIGS. 2–4, the conductive circuit loading structure 11 is more fully described. The vacuum envelope 2 comprises a metal block structure, as of copper, having an axially directed bore 12 therein. The helical slow wave circuit 6 is axially directed of the bore 12 and is supported in the bore 12 by means of three axially directed dielectric rods 13, as of alumina, beryllia or sapphire. The conductive circuit loading structure 11 is formed by three axially directed conductive channel members 14 as of stainless steel. The channel members 14 extend for substantially the entire length of the circuit 6 and are disposed with the open side of the channel members 14 facing the helix 6 and with the side edges of the channel members terminating adjacent said slow wave circuit in spaced relation therefrom at a radius, *b*, from the axis of the helix 6. The helix 6 has an outside radius, *a*. The sides 15 of the channel members 14 define a plurality of conductive vane members radially projecting from the inside of the bore 12 toward the slow wave circuit 6.

The conductive vanes 15 serve to interrupt the circumferential currents associated with the r.f. electromagnetic field surrounding the helix while providng conductive paths for conducting currents associated with such r.f. fields in both the axial and radial direction relative to the helix 6. The innermost edges of the vanes 15 approximate a plurality of longitudinally directed wires for loading the helix circuit 6 in a manner more fully described below with regard to FIGS. 5–10.

In a typical S-band example each channel member 14 subtends approximately 60° of arc at its outer radius adjacent the inside surface of the bore 12 and the channel members 14 have a radial depth of approximately 0.065 inch. The side edges of the vanes 15 are spaced approximately 0.030 inch from the outside of the helix 6. The channel members 14 extend for substantially the entire length of the helix 6, which, in the S-band example, is approximately 8 inches. Such a tube loaded in the aforecited manner has an ultra wide bandwidth of approximately two octaves center at S-band.

Figure 5:
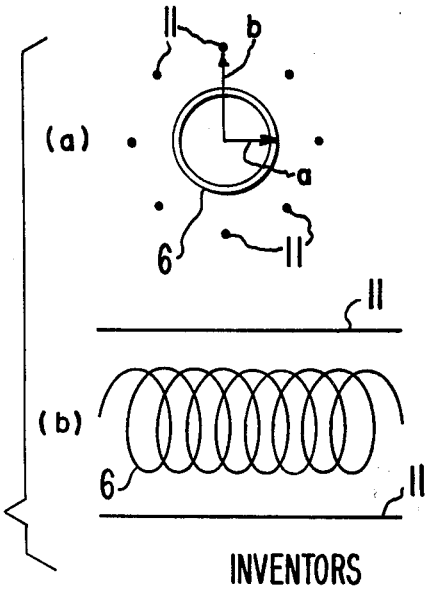

Referring now to FIG. 5, the free side edges of the channel members, which approach the helix circuit 6, approximate an array of longitudinally directed conductive wires, as shown in FIG. 5 (*a*). The wires are disposed at a radius, *b*, from the axis of the helix, such helix 6 having an outside radius, *a*. Such a loaded circuit is shown in longitudinal sectional view in 5 (*b*). Such a circuit is employed in video delay lines and is known to have a phase velocity for various ratios of the radii *a* and *b* as shown in FIG. 6. The ordinate parameter in FIG. 6 is $$\frac{ka \cot \psi}{\beta a}$$

and is proportional to normalized phase velocity where

- $k$ is $\omega/c$ where $\omega$ is the radian frequency and $c$ is the velocity of light.
- $a$ is the radius of the outside of the helix.
- $b$ is the radius to the inside surface of the longitudinal wires.
- $\beta$ is the phase constant.
- $\psi$ is the pitch angle that the conductor of the helix makes with a plane normal to the axis of the helix, and the abscissa parameter $ka \cot \psi$ is proportional to frequency.

From FIG. 6 it is seen that for ratios of $b/a$ within the range of 1.5 to 1.01 that the phase velocity for wave energy within the passband of the circuit increases with frequency across the passband of the circuit. The synchronism condition between the wave energy on the circuit and the slow beam space charge wave is related by the following relation $$b = \frac{1}{c}\left(\frac{u_0}{v} - 1\right) \qquad \text{Eq. (1)}$$

- $u_0$ is the beam velocity,
- $v$ is the velocity of the circuit wave,
- $b$ is Pierce's synchronism parameter, and
- $c$ is Pierce's gain parameter The value of $c$ decreases with frequency. Thus, to maintain the value of $b$ at a relatively constant value over the passband of the circuit, the ratio of $(u_0/v)$ must decrease with an increase in frequency. Since $u_0$ is constant, the circuit wave velocity must increase with frequency. Such a condition is obtained when the ratio of $b/a$ is within the range of 1.5 to 1.01. Thus, the conductive circuit loading structure 11 should be dimensioned relative to the helix 6 such that the ratio of $b$ to $a$ falls within the range of 1.5 to 1.01 in order to obtain an increasing phase velocity with frequency over the passband of the circuit to produce a constant synchronism parameter $b$.

Referring now to FIG. 7, there is shown in cross section a typical prior art standard helix circuit wherein the helix 6 is coaxially disposed of the bore 12 in the envelope 2 and supported therefrom via three longitudinally directed dielectric rods 13. This arrangement leads to a phase velocity $V_p$ and synchronism parameter $b$ as shown in FIG. 8, where th phase velocity $V_p$ decreses with increasing frequency and the synchronism parameter $b$ increases with increasing frequency. Such a traveling wave tube amplifier exhibits conventional bandpass characteristics as of less than one decade such as from frequency $f_0$ to $2 f_0$.

Prior art attempts to correct this dispersive characteristic of the helix were by the provision of a non-dispersive helix 6. The non-dispersive helix is provided by placing a dielectric loading structure between the outer surface of the helix 6 and the inner surface of the surrounding conductive bore or sheath 12. This dielectric loading results in a non-dispersive helix as depicted in FIG. 9 wherein the phase velocity $V_p$ is constant over the passband of the circuit. A constant phase velocity $V_p$ leads to a synchronism parameter $b$ which increases with increasing frequency over the passband and results in a moderate increase in the bandwidth of the circuit.

However, the conductive circuit loading structure 11 of the present invention, as shown in FIGS. 2–4 and which is equivalent to the longitudinal wires of FIGS. 5 and 6 results in a phase velocity $V_p$ as shown in FIG. 10. In this circuit the phase velocity $V_p$ increases with increasing frequency over the passband of the circuit and can be arranged to result in a synchronism parameter $b$ which remains constant over the passband of the circuit, as shown. Such a loading structure 11 substantially increases the bandwidth of the traveling wave tube resulting in an ultra wide bandwidth of approximately two octaves, i.e., $f_0$ to $4 f_0$. The increasing phase velocity with increasing frequency over the passband is obtained when the ratio of the inside radius of the loading structure 11 to the outside radius of the helix 6, namely, the ratio $b/a$ falls within the range of 1.5 to 1.01. Such loading structure 11 preferably extends over the entire length of the helix 6 and should extend at least over one-half the length of the circuit.

Although the slow wave circuit 6 has been described as a helix, other topologically equivalent helix circuits may be employed as well as helix derived circuits. Such topologically equivalent helix circuits and helix derived circuits include the conventional ring-and-bar circuit, ring-loop circuit, contra-wound helices, folded helix circuit and the bifilar helix.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. In a traveling wave tube amplifier, means forming a helix derived slow wave circuit, a conductive sheath surrounding said slow wave circuit, means for projecting a stream of electrons along said slow wave circuit for electromagnetic interaction with signal wave energy on said slow wave circuit to produce an amplified output signal, means at the downstream end of said slow wave circuit for extracting the amplified output signal, the improvement comprising, means forming a conductive circuit loading structure disposed outside of and adjacent said slow wave circuit and extending along said circuit over more than one-half of its length for interrupting circumferentially directed currents associated with fields around the outside of said slow wave circuits while conducting currents along the length of said slow wave circuit to provide a phase velocity for signal wave energy which increases with frequency over the passband of said slow wave circuit to provide a nearly constant synchronism parameter over the passband of said slow wave circuit, said conductive loading structure including a plurality of elongated conductive vane members surrounding said slow wave circuit, said vane members being oriented to project radially inwardly from the wall of said conductive sheath towards said slow wave circuit, said vane members being axially directed of said slow wave circuit and terminating adjacent said slow wave circuit in radially spaced relation therefrom.

2. The apparatus of claim 1 wherein said conductive circuit loading structure comprises at least one channel member in contact with the inner wall portion of said conductive sheath, said vane members forming side portions of said channel member.

3. The apparatus of claim 1 wherein the radial spacing $b$ from the axis of said slow wave circuit to the inside edges of said conductive vane members is within the range of 1.5 to 1.02 times the radial spacing $a$ from the axis of said slow wave circuit to the outside surfaces of said slow wave circuit.

4. The apparatus of claim 3 including a plurality of dielectric rods disposed about the outer circumference of said slow wave circuit, extending along the length of said slow wave circuit, and insulatively supporting said slow wave circuit from said surrounding conductive sheath.

* * * * *